US012600688B2

(12) United States Patent
Gustavsson et al.

(10) Patent No.: US 12,600,688 B2
(45) Date of Patent: Apr. 14, 2026

(54) SENSITIZING COMPOSITION FOR ENERGETIC HYDROGEN PEROXIDE EMULSIONS

(71) Applicant: HYPEX BIO EXPLOSIVES TECHNOLOGY AB, Farsta (SE)

(72) Inventors: Thomas Gustavsson, Hägersten (SE); Robert Håkland, Enskede (SE); Stefan Nilsson, Årjäng (SE)

(73) Assignee: HYPEX BIO EXPLOSIVES TECHNOLOGY AB, Farsta (SE)

( * ) Notice: Subject to any disclaimer, the term of this patent is extended or adjusted under 35 U.S.C. 154(b) by 0 days.

(21) Appl. No.: 18/289,153

(22) PCT Filed: May 4, 2022

(86) PCT No.: PCT/EP2022/062014
§ 371 (c)(1),
(2) Date: Nov. 1, 2023

(87) PCT Pub. No.: WO2022/233955
PCT Pub. Date: Nov. 10, 2022

(65) Prior Publication Data

US 2024/0239720 A1 Jul. 18, 2024

(30) Foreign Application Priority Data

May 5, 2021 (EP) ..... 21172318

(51) Int. Cl.
*C06B 23/00* (2006.01)
*C06B 47/14* (2006.01)

(52) U.S. Cl.
CPC ..... *C06B 23/004* (2013.01); *C06B 47/145* (2013.01)

(58) Field of Classification Search
None
See application file for complete search history.

(56) References Cited

U.S. PATENT DOCUMENTS

| | | | |
|---|---|---|---|
| 3,617,401 | A | 11/1971 | Mortensen et al. |
| 3,706,607 | A | 12/1972 | Chrisp |
| 3,790,415 | A | 2/1974 | Tomic |
| 3,886,010 | A | 5/1975 | Thornley et al. |
| 4,475,965 | A | 10/1984 | York et al. |
| 4,942,800 | A | 7/1990 | Bouillet et al. |
| 7,491,279 | B1 | 2/2009 | Baker |
| 8,802,613 | B2 | 8/2014 | Bonislawski et al. |
| 2015/0247395 | A1 | 9/2015 | Stehle |
| 2019/0233347 | A1 | 8/2019 | Halander et al. |
| 2022/0242803 | A1 | 8/2022 | Kettle |

FOREIGN PATENT DOCUMENTS

| | | | | |
|---|---|---|---|---|
| WO | WO-2013013272 | A1 * | 1/2013 | ..... C06B 43/00 |
| WO | 2018107213 | A1 | 6/2018 | |
| WO | 2018222138 | A1 | 12/2018 | |
| WO | 2020085986 | A1 | 4/2020 | |
| WO | 2020243788 | A1 | 12/2020 | |

OTHER PUBLICATIONS

WO2013013272 (Year: 2013).*
Extended European Search Report dated Dec. 7, 2021 for EP Application No. 21172318.4, 9 pages.
Extended European Search Report dated Nov. 3, 2021 for EP Application No. 21172313.5, 7 pages.
Extended European Search Report dated Nov. 3, 2021 for EP Application No. 21172315.0, 7 pages.
Halme, T., "Development of nitrogen free environmentally friendly blasting explosive," Helsinki Conference Proceedings 2019, pp. 393-398.
Partial European Search Report dated Nov. 5, 2021 for EP Application No. 21172318.4, 12 pages.
PCT International Preliminary Report on Patentability dated Jul. 24, 2023 for International Application No. PCT/EP2022/062014, 10 pages.
PCT International Preliminary Report on Patentability dated Mar. 24, 2023 for International Application No. PCT/EP2022/062007, 5 pages.
PCT International Preliminary Report on Patentability dated Mar. 29, 2023 for International Application No. PCT/EP2022/062011, 12 pages.
PCT International Search Report and Written Opinion dated Aug. 18, 2022 for International Application No. PCT/EP2022/062007, 9 pages.
PCT International Search Report and Written Opinion dated Aug. 19, 2022 for International Application No. PCT/EP2022/062011, 8 pages.
PCT International Search Report and Written Opinion dated Aug. 19, 2022 for International Application No. PCT/EP2022/062014, 7 pages.

* cited by examiner

*Primary Examiner* — Aileen B Felton
(74) *Attorney, Agent, or Firm* — RMCK Law Group, PLC

(57) ABSTRACT

A sensitizing composition for generating gas bubbles in an energetic hydrogen peroxide emulsion is disclosed. The sensitizing composition comprises a liquid carrier, a solid hydrogen peroxide catalyst which is dispersed in the liquid carrier and; a coating agent which is non-soluble in hydrogen peroxide and in water and which is arranged to coat the solid hydrogen peroxide catalyst dispersed in the liquid carrier. A method of preparing such a sensitizing composition is also disclosed.

9 Claims, No Drawings

SENSITIZING COMPOSITION FOR ENERGETIC HYDROGEN PEROXIDE EMULSIONS

CROSS-REFERENCE TO RELATED APPLICATIONS

This application is a 371 U.S. National Stage of International Application No. PCT/EP2022/062014, filed May 4, 2022, which claims priority to European Patent Application No. 21172318.4, filed May 5, 2021. The disclosures of each of the above applications are incorporated herein by reference in their entirety.

FIELD OF INVENTION

The present invention relates to a composition for forming a sensitizing agent which can be used to chemically sensitize energetic hydrogen peroxide based emulsion compositions. The invention also relates to a method of preparing such a composition.

The invention is intended to be used with hydrogen peroxide-based emulsion type explosives with uses in the mining and civil rock blasting applications. It is to be understood that the invention is not limited to these specific fields of use.

BACKGROUND OF THE INVENTION

The invention should be put in relevant context to allow for a better understanding of the benefits and advantages the invention offers. This Section acts as a discussion of the prior art to offer such context. It is to be understood that any topic, discussion or argument stated in the discussion should not necessarily be considered to be common knowledge or widely known or form any position of what is to be considered general knowledge in the field.

Today, most bulk mining explosives contain large portions of nitrate bearing oxidizer compounds, normally nitrate salts. The most common of these are the nitrate salt ammonium nitrate (AN). AN is used as source of oxygen, occasionally in combination with other nitrate or chlorate oxidizers and its use in the field is well known. Nitrate based oxidizers have been used in the mining industry as base for explosive compositions for nearly 70 years. Combined with various fuels, viscosity and rheology modifiers, energy and density modifying agents, nitrate salts as AN can be used to form a wide array of explosives with various properties.

Nitrate based explosives were initially offered as pure ammonium nitrate powder or prill. It was soon realized that by adding fuel, an increase in efficiency could be reached. By combining the nitrate salts with fuel oil (FO), a well know composition was created—ANFO. Still widely used today, ANFO offers an easy means to make a cheap and yet effective explosive.

Due to the hydroscopic nature of AN, ANFO comes with a very poor water resistance. This implies a need to develop alternative solutions and has led to the development of nitrate based slurries and water gel explosive compositions. These compositions utilized AN solutions (ammonium nitrate solved in water) together with water soluble fuels and thickeners to achieve an explosive with improved water resistance and a more rigid structure.

Water gel technology has been followed by water in oil emulsions which combine a hot AN/water solution containing a high AN concentration with an oil fuel phase. The emulsion is normally stabilized with an emulsifier which bonds droplets of AN solution to droplets of oil phase fuels.

AN emulsions and water gels require sensitization which is known in the art to be commonly done by incorporating small voids or enclosed bubbles of gas into the composition. These are commonly referred to as "hot spots". Sensitization may also be done by adding highly energetic materials such as Trinitrotoluene (TNT), Pentaerythritol tetranitrate (PETN), Octogen (HMX), RDX, aluminium or similar. However, hot spot voids is the most common form of sensitization for bulk explosive applications.

Sensitization in this context implies a method to ensure the reliable detonability of an explosive composition during certain conditions. The process of adding bubbles or voids into the composition increase the sensitivity of the explosive to be reliably detonated using a booster or primer pressure amplification charge and occasionally also sensitive enough to be detonated by a standard PETN, RDX or HMX based detonator. Usually, the sensitization also implies density modifications to adapt the explosive energy to the application requirements.

Bubbles may be incorporated into the explosive composition by either adding hollow, pre-made enclosed spheres made of glass, plastic or cellulose or by injecting gas directly into the composition or by generating gas bubbles inside the composition through a chemical reaction. Some applications exist where foams are generated separately and incorporated into the explosive. By adding voids to an explosive composition, the sensitivity, density and the amount of energy delivered upon detonation can be modified.

Use of gas filled micro balloons such as glass, plastic or cellulose hollow spheres or small porous particles such as expanded polystyrene, ash, volcanic rock or similar are known in the art to sensitise explosive compositions by adding voids and mechanically adding and mixing these into the composition.

Micro balloons are challenging due to the tendency of the low-density particles to dust and clump together. Micro balloons tend to solidify and behave in a non-Newtonian manner if stored or processed in larger quantities. This behaviour is challenging to manage in a manufacturing process.

If added into highly viscous compositions where aggressive mixing is required to ensure reliable dispersion the mixing may destroy or collapse the microspheres to some extent which require additional spheres to be added to reach the desired density which increases cost. Micro balloons are also relatively expensive which makes this sensitization method more expensive in contrast to a chemical gassing approach.

In-situ chemical sensitization is the industry standard for bulk explosives and is well known in to increase sensitivity and to modify density. U.S. Pat. No. 3,886,010 (Thornley) and U.S. Pat. No. 3,706,607 (Chrisp) describes such in-situ gassing processes by adding various chemicals such as nitrate compounds or peroxides into AN based slurries and emulsion compositions. These chemicals are added into the AN based composition in powder or liquid form and causes a reaction with the ammonium ions naturally present in the composition. A water solution containing sodium nitrite is commonly used as sensitizer agent. Another proposed solution is to use fine powders such as described in U.S. Pat. No. 4,997,494 (Nguyen).

Bubble size is very relevant to the effectiveness of the sensitization. It has been found that bubbles should be in the micro meter (micron) range (10-1000 microns) to be effective. Bubbles incorporated with chemical gassing forms in diameters following a normal distribution. It is possible to form bubbles ranging from 30-300 microns.

The standard method of using liquid solutions of gassing reactant normally forms bubbles of larger sizes as it is challenging to disperse and mix droplets of micron size into the high viscosity explosives composition. Bubbles allowed to migrate also coalescence to form larger bubbles. It is therefore relevant to ensure that the explosive composition is stable and preferably highly viscous before gassing takes place. Surfactants may be incorporated to lower surface tension to counteract this challenge to some extent.

Modern AN based explosives delivery system normally processes non-sensitized explosive compositions just until the moment of loading the explosive into the drill hole. This method is preferred by the industry and commonly applied to mediate process risk as it ensures that no sensitized explosive is handled by machinery until the point of use. To achieve this, sensitization must occur as close as possible to the drill hole, preferably only when placed in the rock. As the approach of adding micro balloons or gas injection requires equipment to mix, inject or stir the explosive it is not possible to sensitize/gas in-situ in the rock. This is not the case with chemical gassing as the chemical sensitization agent may be added to the explosive before loading into the drill hole and based on the agent's characteristics in conjunction with the explosive may delay the forming of bubbles and gassing process for a long enough time to allow it to be pumped into the drill hole and thereby only sensitize the explosive once in-situ of the rock.

Nitrate based explosives exhibit many drawbacks. AN and other nitrate salts are energy inefficient to produce and has a large carbon footprint as a result. Hence, the production process of AN has a negative environmental and economic impact.

Further, due to the high nitrate content, AN explosive produces high levels of toxic nitrogen oxide gases, commonly known in the industry as $NO_x$ gases. These toxic gases have significant impact on mining operations as they constitute a health and safety issue for mine personnel. Residue nitrates left in blasted rock also leeches of the rock mass into naturally occurring water which causes contamination. The impact of nitrate residues from explosives use is well known challenge for the extractive industries globally.

To address this issue, efforts have been made to eliminate or minimize the use of nitrate salts as oxidizers in explosives compositions. One replacement, which has been proven effective, is hydrogen peroxide (HP). Work done in this field by Araos (WO2020085986A1 or WO 2013/013272) and WO 2020/243788 A1 (Kettle) outlines the most recent developments of using HP as a replacement oxidizer to AN.

HP is naturally unstable and decomposes exothermically to water and oxygen over time. Stabilizers (examples are phosphonic acids or tin based compounds) are added into commercially available HP solutions. These stabilizers slow down the decomposition process to one or a few percent per year if stored at cool temperatures.

The decomposition rate is accelerated by impurities, temperature and increased pH and formulating stable and non-reactive HP explosive compositions have proven to be a challenge as formulations tend to react with the rock wall or materials commonplace in the industry.

Decomposing HP due to impurity or catalytic circumstances may create an accelerated exothermal reaction which in some cases can cause the HP based composition to catch fire or reach temperatures where conventional initiation systems (such as detonators) spontaneously detonate. The reactive nature of HP is a health and safety concern and is the main reason why HP based explosive compositions is not well known and practically not used in the industry. Therefore, little prior art exists concerning HP based explosive compositions.

In the most recent work done in the field, Araos proposes in PCT patent WO 2013/013272 the use of chemical gassing techniques for emulsions but no actual formulation is provided with practical results. Araos supplies one example where gassing was conducted by using a 5% solution of potassium permanganate and water which was added into a water gel type explosive composition. The result shown was that the bubbles were lost while physically moving the composition by pouring it into a testing pipe. Another effort on this topic was made by T. Halme (Forcit Oy, Finland) in article *Development of nitrogen free environmentally friendly blasting explosive* (*Helsinki EFEE Conference Proceedings*2019, R. Holmberg et al). Halme argues that chemical gassing is seen as a future potential but practical utilization belongs to future work indicating that available methods at the time were deemed non-functional and inappropriate during the work conducted. No chemical gassing method is proposed by Halme.

Definitions

Without wishing to be bound by any theory, the terms employed in the present invention should have the following meaning;

Coalescence—Shall mean the same as bubble coalescence which is a process by which gas bubbles in an emulsion explosive collide and form a larger bubble.

Coating agent—Shall mean a substance which reduces the reaction area of a catalyst by coating at least a portion of the surface of a catalyst or by reducing mass transfer in a fluid comprising the coating agent.

Carrier—Shall mean the medium which is liquid or semi-liquid upon application in which a catalyst may be suspended. The carrier may also offer a coating or a coating substance may be included in the carrier.

Coating carrier—Shall mean the medium forming a coating agent, in which a catalyst can be dispersed or suspended.

Catalyst—Shall mean a substance which catalyses decomposition of hydrogen peroxide under the formation of oxygen. The catalyst may or may not be consumed by the catalysis reaction. The substance may be dispersed, suspended or dissolved in a medium.

Catalysis—Shall mean the process of accelerating the rate of hydrogen peroxide decomposition into water and oxygen.

Decomposition—Shall mean the process where the hydrogen peroxide molecules are broken down into oxygen and water where the oxygen forms oxygen gas.

SUMMARY OF THE INVENTION

An object of the invention is to provide an enhanced sensitizing composition for generating gas bubbles in an energetic hydrogen peroxide emulsion.

According to a first aspect, the sensitizing composition comprises a liquid carrier, a solid hydrogen peroxide catalyst which is dispersed in the liquid carrier and a coating agent which is non-soluble in hydrogen peroxide and in water and which is arranged to coat a solid hydrogen peroxide catalyst dispersed in the liquid carrier.

When the sensitizing composition is added to an energetic hydrogen peroxide emulsion, the catalyst of the sensitizing composition catalyses the decomposition of the hydrogen peroxide. The decomposition of hydrogen peroxide results in the formation of oxygen bubbles which act as hotspots during the detonation process of the energetic emulsion. Such sensitizing of an energetic emulsion is also referred to as gassing the energetic emulsion. By adding a coating agent to the sensitizing composition, the catalytic reaction may be controlled to thereby prevent so called over-gassing. Over-gassing may otherwise result in severe problems. Such over-gassing may e.g. result in that the gas bubbles coalesce to form bubbles of a size which is too large to allow propagation of the flame front during detonation. Over-gassing may also result in that the hydrogen peroxide emulsion is broken, whereby the hydrogen peroxide oxidizer phase is separated from the oil type fuel phase. In both cases, the over-gassing problems may result in severely deteriorated explosive capabilities or in that the energetic emulsion is rendered completely incapable of detonating. Additionally, if the catalyst remains solid in the sensitizer composition and by extension inside the HP emulsion composition, gassing precision may be challenging to control as the solid particles may migrate inside the emulsion column and create undesirable excess decomposition or destabilize the HP emulsion. This migration occurs due to bubble coalescence creating voids allowing the solid catalysts further movement inside the emulsion. Migration could also occur if the viscosity of the HP emulsion is low allowing for the catalyst particles to flow inside.

The coating agent comprised in the sensitizing composition solves this problem by reducing the reactive area between the catalyst and the hydrogen peroxide. Since the coating agent is non-soluble in hydrogen peroxide and water it has the ability to physically coat the solid catalyst particles to thereby prevent or reduce the contact between the hydrogen peroxide and the catalyst. This in contrast to hydrogen peroxide and water soluble coating agents which would not have this ability and which would have a tendency to decompose or disappear over time. In cases where the catalyst is formed of dispersed particles, the coating agent covers at least portions of the physical surface of the catalyst particles to thereby reduce the reactive area and control the catalytic decomposition reaction.

By adding a coating agent into the sensitizer composition which applies a non-reactive coating layer over the catalytic particles, the migration may be prevented by controlling the available surface area of the catalyst. For example, using an in HP insoluble carrier such as an oil will allow a surface area to be created during injection mixing but once bubbles are formed, the oil coating will limit or prevent further contact surface between HP and catalyst which improves controllability and precision of the gassing process.

The decomposition occurs where the surface area of the catalyst interacts with the HP—the reaction area—and the size of the gas bubbles formed is affected by the size and geometry of the reaction area. Reaction area defines the theoretical maximum area where a contact between HP and a catalyst may allow decomposition to be accelerated. However, the available reaction area is further limited by other factors such as available free HP in the emulsion (and by extension, the viscosity and stability of the HP emulsion) and other components which may coat the catalyst to prohibit a contact surface to form. Theoretically, the total density change possible due to gassing in the HP emulsion is directly related to the available reaction area.

During the injection and mixing phase where the sensitizing composition is added and mixed into the emulsion, the available reaction area is increased as a function of mixing. Once the HP emulsion leaves the mixing chamber, the sensitizer is dispersed in the emulsion and the HP catalysis begins.

The coating agent may further bond the carrier to increase viscosity. In this case, the coating agent and carrier may form a unison physical barrier between the HP emulsion and the catalyst.

By selecting a suitable coating agent for the hydrogen peroxide emulsion in question, the catalytic decomposition reaction may be precisely controlled such that the formation of sensitizing gas bubbles is correctly adapted to the composition of the emulsion and to the circumstances at which the energetic emulsion is to be used.

The use of such a sensitizing composition comprising a coating agent allows for that the sensitization/gassing is achieved close to the point of use of the explosive emulsion. It is e.g. possible to accomplish the sensitization/gassing in a process involving pumping, mixing and charging the explosive emulsion. The sensitizing composition further allows for delayed sensitization/gassing and detonation sensitivity control of the explosive emulsion.

The sensitizing composition may e.g. be added to the energetic emulsion in a loading process where the HP emulsion composition is pumped by automatic dosing pumps and mixers which injects and mixes the sensitizing composition into the HP emulsion prior to placement in the blast hole or into a packaging.

Automatic injection of gassing agents assumes that the medium is in a liquid or semi liquid form upon the point of injection. When the HP catalysts are solids, the catalysts should be suspended or dissolved in a liquid carrier medium to allow for precision dosing though for example a screw pump. Such pumps have a precision tolerance where the accuracy of the dosing relates to a minimal flow of liquid.

For the sake of clarity, the sensitizing composition must be liquid during the injection phase to allow pumps to manage precision dosing. However, the composition may be solid or semi sold during any other phase such as storage or once incorporated into the HP emulsion.

The liquid carrier may constitute the coating agent. Hence, the carrier itself may act as a coating agent, for instance if low viscous oils or if melted waxes are used as carrier. In this case the composition contains a coating carrier.

In cases where the hydrogen peroxide catalysts is dispersed in the liquid carrier, the catalyst may comprise a substance selected from the group consisting of metal powders, metal oxide powders, carbon powders, charcoal powders, graphite powders and cellulose powders, The coating agent may be selected from the group consisting of; mineral oils, petroleum oils, aromatic oils, bio-oils, synthetic fuel oils, diesel oils, lubrication oils, kerosene oils, naphtha oils, paraffin oils, lubrication oils, chlorinated paraffin oils, micro benzene oils, toluene oil, polymeric oils, rapeseed oils, coconut oils, fish oils, microcrystalline wax, paraffin wax, animal wax, plant wax, montan wax, polyethylene wax, polyethylene derivative wax and aluminium powder. For example, aluminium powder allows for an improvement in coating from a non-catalytic solid with a high specific surface area. One such example is flake aluminium powder which offers a strong physical barrier between catalyst particles In cases where gassing must be very precise or where the coating of the catalyst must be particularly strong, a wax could be advantageous as a coating carrier. In this case, the wax is heated over its melting temperature and the catalyst is added into the melted wax. Upon application into the loading process and injection/mixing process, the waxed composition is heated and melted to ensure a liquid state.

A waxed composition may accelerate decomposition during the mixing state as the heat from the composition would reinforce the catalytic effect of the catalyst. As the HP emulsion normally are cooler than the melting temperature of the wax, the sensitizer agent would solidify inside the wax and fix the catalysts inside the emulsion thereby halting the decomposition process.

An alternative to wax is a lubricant grease or jelly which normally have the form of a liquid or semi-liquid in room temperature. Such greases normally comprise of oils or oil emulsions in combination with an oil thicker such as calcium stearate, sodium stearate, lithium stearate.

The sensitizer composition may comprise a surfactant. Such surfactants lower the surface tension of the gas bubbles formed. Bubble size is affected by the surface tension of the HP emulsion and sensitizer composition. By incorporating surfactants in the composition, bubble size may be lowered by preventing coalescence to some extent.

The sensitizer composition must be able to maintain liquid form when incorporated into the emulsion. In the case of using wax as coating carrier, the sensitizer agent may be pre-heated and kept hot to ensure a liquid state.

The sensitizer composition may further comprise an anti-freezing agent. This enables use in applications in colder climates where the surrounding temperatures are below freezing points for possible carriers. In such circumstances, anti-freezing compounds may be added to the composition to ensure the liquid form. Non limiting examples of such compounds are ethylene glycol, propylene glycol, alcohols or glycerol.

The hydrogen peroxide catalyst may be a solid in powder form with a particle size less than 50 micrometres. Catalyst particles may e.g. be in the range of 2 to 50 micro metres (microns), preferably in the range of 2 to 15 microns. The ideal gas bubble size depends on the characteristics of the HP emulsion explosives and external factors such as diameter, drill hole pressure, initiation pressure and heat but should be less than 120 micrometres, preferably the bubble size should be between 5-30 micrometres. To delay or hinder coalescence behaviour, a surfactant or other surface tension modifier may be added to the carrier to allow for formation of smaller bubbles.

As the catalyst remains solid inside the sensitizer composition, the available reaction area is defined by the geometry, porosity and particle size of the catalyst. Flake powders of small particle size may have a higher effective reaction area compared to spherical powders with low porosity. Further, bubble coalescence occurs around the reaction area until no HP enclose the catalyst (assuming the catalyst is not consumed in the reaction). Particle size and geometry is therefore important to consider when selecting a catalyst to allow for effective bubble generation and size.

The hydrogen peroxide catalyst may constitute 0.05-9% by weight of the sensitizer composition, preferably between 0.1-4% by weight. It has been found that very small amounts of catalysts are required acquire the desired decomposition effect which implies that the catalyst should be diluted by the carrier to an extent and a ratio that allows for precision dosing based on the flow accuracy of the dosing pump. This in combination with adding sufficient catalyst to reach the desired density of the HP emulsion.

The application and conditions where the HP emulsion are to be used in conjunction with the sensitizer should be considered when selecting a catalyst. For example, a carbon powder may be a better solution for a colder drill hole and a permanganate salt solution may be better if gassing time (the time it takes for the HP emulsion to reach the desired density) is a prioritized characteristic. Examples of such considerations include gassing time, emulsion stability and texture, target densities, stability, gas bubble size, drill hole pressure and climate.

The amount of catalyst in the sensitizing composition may be between 0.05-9% by weight, preferably between 0.1-4% by weight.

The sensitizer composition may further comprise an oil component, a water-soluble component and an emulsifier wherein the composition is prepared as an emulsion. It has been found that preparing the sensitizer composition as an emulsion of the same dispersion kind (water in oil or oil in water) as the HP emulsion tend to improve homogenization of the sensitization composition into the HP emulsion upon mixing. Further, preparing the gassing agent as an emulsion has been shown to improve stability of the HP emulsion, particularly when the HP emulsion is of lower viscosity.

According to a second aspect there is provided a method of preparing a composition for generating gas bubbles in an energetic hydrogen peroxide emulsion. The method comprises dispersing at least one hydrogen peroxide catalyst into a liquid carrier and adding a coating agent into the dispersion.

At an embodiment of the method, the hydrogen peroxide catalyst is combined with an oil component, a water-soluble component, and an emulsifier to form an emulsion.

According to a third aspect, the sensitizing composition comprises; a liquid carrier; a solid hydrogen peroxide catalyst which is dissolved in the liquid carrier and; a coating agent which is non-soluble in hydrogen peroxide and in water and which is arranged to increase the viscosity of the emulsion to thereby decrease mass transfer of a hydrogen peroxide catalyst dissolved in the liquid carrier.

In cases where the catalyst comprises a dissolved catalytic substance, the coating agent increases the viscosity of the emulsion to thereby reduce mass transfer through the emulsion. In this manner, the reactive area is reduced by a decrease of the collision rate between the catalyst and hydroperoxide molecules.

At embodiments of the sensitizing composition according to the third aspect, the hydrogen peroxide catalyst may comprise a substance selected from the group consisting of; permanganate, potassium permanganate, permanganate salts, carboxylates, carbonate salts, sodium carbonate and sodium bicarbonate.

The coating agent may comprise a thickener selected from the group of organic gums, agar gum, gum arabica, xanthan gum, carrageenan gum, locust bean gum, silicone gums, gelatine, alginate cross-linkers, polyacrylic polymer thickeners, carboxylic or polycarboxylic acids, starches, pectin, calcium stearate, sodium stearate, lithium stearate, and aluminium complex thickeners.

The sensitizer composition may further comprise a surfactant.

The sensitizer composition may also comprise an anti-freezing agent.

The hydrogen peroxide catalyst may be a solid in powder form with a particle size less than 50 micrometre.

The hydrogen peroxide catalyst may be a water-soluble salt.

The hydrogen peroxide catalyst may constitute 0.05-9% by weight of the sensitizer composition.

The sensitizer composition may further comprise; an oil component; a water-soluble component; and an emulsifier, and the sensitizer composition may be prepared as an emulsion.

According to a fourth aspect there is provided a method of preparing a sensitizer composition for generating gas bubbles in an energetic hydrogen peroxide emulsion, which method comprises dissolving at least one hydrogen peroxide catalyst into a liquid carrier and adding a coating agent into the solution.

EXAMPLES

The sensitizing composition is used for generating gas bubbles in an energetic hydrogen peroxide emulsion composition. The sensitizing composition comprises; liquid carrier and a solid hydrogen peroxide catalyst which is dispersed or dissolved in a liquid carrier. A coating agent is arranged to coat a solid hydrogen peroxide catalyst dispersed in the liquid carrier or to increase the viscosity of the emulsion to thereby decrease mass transfer of a hydrogen peroxide catalyst dissolved in the liquid carrier.

By adding a coating agent, the composition allows for higher control of sensitivity range, densities and gassing time for the hydrogen peroxide emulsion composition. Such to allow for delayed sensitisation and density allowing for initiation with conventional means such as a detonator with or without an amplification charge (known as a primer or booster).

The sensitizing composition may be prepared by a method comprising dispersing or dissolving at least one hydrogen peroxide catalyst into a liquid carrier and adding a coating agent into the dispersion or solution respectively. The coating agent may be added to the liquid carrier before, during or after dispersing or dissolving the hydrogen peroxide catalyst into the liquid carrier.

The present invention can be used for a variety of forms of emulsion type explosive compositions provided of course that the principles of the invention as described herein are observed. The formation and use of some exemplifying sensitizing compositions according to the invention are given in examples 1-4 below.

Example 1

| Substance | Function | Ratio (Weight %) |
|---|---|---|
| Carbon powder (30 micron) | Catalyst | 0.6% |
| Xanthan gum | Coating agent | 1.4% |
| Distilled water | Carrier | 98% |

The carbon powder was added to the water and then the Xanthan gum was slowly dispersed under mixing. The result was a fluid sensitizing composition in the form of a low viscous black gel in which the carbon powder was suspended. 2% by weight was added and mixed to a high viscous energetic hydrogen peroxide emulsion. The hydrogen peroxide emulsion comprised an oil phase with a mineral oil having a density of 0.83 g/cm$^3$ combined with one PIBSA type emulsifier and one SMO type emulsifier and the oxidiser phase comprised a hydrogen peroxide and water solution of 49.9% by weight concentration. The emulsion was sensitized in 20 minutes at 14 degrees Celsius. The emulsion was detonated in a 38 mm steel pipe with 2 mm wall thickness using an 8d detonator and the detonation velocity was determined to be approximately 4000 m/s·s The emulsion stayed stable over 30 days in sensitized state.

Example 2

| Substance | Function | Ratio (Weight %) |
|---|---|---|
| Carbon powder (30 micron) | Catalyst | 0.5% |
| Polycarboxylate thickener | Coating agent | 0.6% |
| Distilled water | Carrier | 98.4% |
| Phosphonic acid | pH modifier | 0.5% |

The carbon powder was added to the water and then the Polycarboxylate thickener was slowly dispersed into the agent while mixing. The result was a black low viscous gel similar to the one in example 1. The reactant was added into an emulsion type explosive such as in example 1 which gassed and increased volume by approximately 10% after 20 minutes in 15 degrees Celsius. The emulsion detonated at 4300 meters/second in a 42 mm plastic hose.

Example 3

| Substance | Function | Ratio (Weight %) |
|---|---|---|
| Iron oxide (rust ~45 microns) | Catalyst | 0.3% |
| Wheat starch | Thickener | 6% |
| Rapeseed oil | Coating agent | 93.7% |

The wheat flour was added into the rapeseed oil during heating. Once all clumps had been dispersed, the iron oxide was added and the reactant was cooled. This resulted in a medium viscosity liquid. The agent was added at 2% by weight and a high shear mixer was used to incorporate the agent into an emulsion type HP explosive such as described in example 1. The emulsion increased in volume by approximately 12% and detonated unconfined in a 50 mm plastic tube using a 25-gram PETN booster.

Example 4

| Substance | Function | Ratio (Weight %) |
|---|---|---|
| Sodium bicarbonate | Catalyst | 0.5% |
| PIBSA | Emulsifier | 1.1% |
| SMO | Surfactant/Emulsifier | 0.4% |
| Rapeseed oil | Coating carrier | 20% |
| Water | Carrier | 78% |

[This is an example of disloving] The Sodium bicarbonate was dissolved in the water creating a water phase. PIBSA, SMO and Rapeseed oil was combined into an oil phase. The water phase was added discontinuously into the oil phase creating a low viscosity gassing emulsion. The gassing emulsion was added into emulsion type HP explosive as described in example 1. The emulsion increased in volume by approximately 10% after 6 hours and detonated unconfined in a 50 mm plastic tube using a 25 gram PETN booster.

The invention claimed is:

1. A sensitizing composition for generating gas bubbles in an energetic hydrogen peroxide emulsion, which sensitizing composition comprises;

a liquid carrier;

a solid hydrogen peroxide catalyst which is dispersed in the liquid carrier; and a coating agent which is non-soluble in hydrogen peroxide and in water, wherein the coating agent is arranged to coat the solid hydrogen peroxide catalyst dispersed in the liquid carrier, wherein the sensitizing composition is separate from the energetic hydrogen peroxide emulsion.

2. A sensitizing composition according to claim 1, wherein the hydrogen peroxide catalyst comprises a substance selected from the group consisting of: metal powders, metal oxide powders, carbon powders, charcoal powders, graphite powders and cellulose powders.

3. A sensitizing composition according to claim 1, wherein the coating agent comprises a substance selected from the group of: mineral oils, petroleum oils, aromatic oils, bio-oils, synthetic fuel oils, diesel oils, lubrication oils, kerosene oils, naphtha oils, paraffin oils, lubrication oils, chlorinated paraffin oils, micro benzene oils, toluene oil, polymeric oils, rapeseed oils, coconut oils, fish oils, microcrystalline wax, paraffin wax, animal wax, plant wax, montan wax, polyethylene wax, polyethylene derivative wax and aluminium powder.

4. A sensitizing composition according to claim 1, further comprising a surfactant.

5. A sensitizing composition according to claim 1, further comprising an anti-freezing agent.

6. A sensitizing composition according to claim 1, wherein the hydrogen peroxide catalyst is a solid in powder form with a particle size less than 50 micrometre.

7. A sensitizing composition according to claim 1, wherein the hydrogen peroxide catalyst is a water-soluble salt.

8. A sensitizing composition according to claim 1, wherein the hydrogen peroxide catalyst constitutes 0.05-9% by weight of the sensitizing composition.

9. A sensitizing composition according to claim 1, further comprising;

an oil component;

a water-soluble component; and an emulsifier, wherein the sensitizing composition is prepared as an emulsion.

* * * * *